US007007935B1

(12) United States Patent
Navarro

(10) Patent No.: US 7,007,935 B1
(45) **Date of Patent: *Mar. 7, 2006**

(54) CLAMPING ARTICLE AND METHOD

(76) Inventor: Ramon Navarro, 4800 Daleview Dr., SP #122, El Monte, CA (US) 91731

( * ) Notice: Subject to any disclaimer, the term of this patent is extended or adjusted under 35 U.S.C. 154(b) by 0 days.

This patent is subject to a terminal disclaimer.

(21) Appl. No.: 10/613,329

(22) Filed: Jul. 3, 2003

Related U.S. Application Data

(63) Continuation of application No. 09/755,409, filed on Jan. 5, 2001, now Pat. No. 6,648,313, which is a continuation-in-part of application No. 09/158,997, filed on Sep. 23, 1998, now abandoned.

(51) Int. Cl.
*B25B 1/00* (2006.01)

(52) U.S. Cl. ..... 269/6; 269/254 R

(58) Field of Classification Search ..... 269/254 R, 269/6, 287; 24/587, 588, DIG. 16, DIG. 17, 24/131 R, 131 L, 129 B, 129 C, 115 A, 16 BB, 24/29, 28, 27, 270, 17 A, 17 B, 18, 23 EE
See application file for complete search history.

(56) References Cited

U.S. PATENT DOCUMENTS 865,623 A * 9/1907 Wood ..... 269/254 R
3,446,212 A * 5/1969 LeRoy ..... 606/158

* cited by examiner

*Primary Examiner*—Robert C. Watson
(74) *Attorney, Agent, or Firm*—Fulwider Patton LLP

(57) ABSTRACT

An article for clamping a plurality of objects together, wherein the article includes a body portion formed in a generally c-shape. The body portion comprises a pair of side portions, an intermediate portion extending between and interconnecting the pair of side portions, and a pair of opposed free end portions extending from the pair of side portions and opposite the intermediate portion and forming a gap therebetween. The pair of opposed free end portions are resiliently biased toward a position proximate each other and spaced apart to the extent of the gap therebetween. They are expandable away from each other upon the exertion of expansion pressure, to extend about the plurality of objects to be clamped therebetween, and to return to the resiliently biased position to exert pressure on the plurality of objects therebetween upon the release of the expansion pressure.

5 Claims, 3 Drawing Sheets

CLAMPING ARTICLE AND METHOD

CROSS-REFERENCE TO RELATED APPLICATION

This application is a continuation of application Ser. No. 09/755,409 filed on Jan. 5, 2001 now U.S. Pat. No. 6,648, 313, which is a continuation-in-part of application Ser. No. 09/158,997 filed Sep. 23, 1998, now abandoned.

BACKGROUND OF THE INVENTION

1. Field of the Invention

This present invention relates generally to clamping articles and, more particularly, to an article for clamping a plurality of objects together to form a bonded unit in a secure and effective manner.

2. Description of Related Art

Objects such as sheets of material have been clamped together by a clamping article to form a bonded unit, wherein the objects to be clamped together may include a layer therebetween of a material for enabling the objects to be secured together. The clamping article is able to exert pressure on the objects at points along the surfaces thereof and/or at junctions of the objects such as corners thereof which may be angular, curved, or squared, to enable bonding of the objects together.

However, such clamping articles have been inefficient and limited in use, in that they have been bulky and able to clamp only a limited ranges of sizes of objects together, and they have also been expensive and inconvenient to utilize. Further, such clamping articles have not been designed for use in a wide range of clamping projects, and have not been practical for clamping objects at multiple locations together.

Therefore, there has existed a need for articles and methods for clamping a plurality of objects together to form a securely bonded unit. The present invention fulfills these needs.

SUMMARY OF THE INVENTION

Briefly, and in general terms, the present invention provides an article for clamping a plurality of objects together, in a secure, efficient and effective manner, while enabling convenient and efficient positioning, engagement, release, and disengagement thereof.

The article for clamping a plurality of objects together is convenient to utilize, able to accommodate a range of clamping projects, and efficient and effective for clamping a multitude of areas on the object together. It may be effectively utilized for securely holding objects such as sheets of material and/or angled corners together for gluing or nailing thereof, for securely holding moldings or forms for leveling together, for laminating, and/or for repairing furniture.

The article includes a body portion, comprised of spring wire, formed in a generally c-shape. The body portion includes a pair of side portions, an intermediate portion extending between and interconnecting the pair of side portions, and a pair of opposed free end portions extending from the pair of side portions and opposite the intermediate portion and forming a gap therebetween. The pair of opposed free end portions are resiliently biased toward a position proximate each other and spaced apart to the extent of the gap therebetween. They are able to be expanded away from each other upon the exertion of expansion pressure on the pair of side portions, so as to extend about the plurality of objects to be clamped between the pair of opposed free end portions, and to resiliently compress towards each other and return to the resiliently biased position thereof to exert pressure on and clamp the plurality of objects between the pair of opposed free end portions, upon the release of the expansion pressure and compression of the pair of side portions responsive thereto.

Other features and advantages will become apparent from the following detailed description, taken in conjunction with the accompanying drawings, which describe and illustrate, by way of example, the features of the invention.

DETAILED DESCRIPTION OF THE PREFERRED EMBODIMENTS

Figure 1:
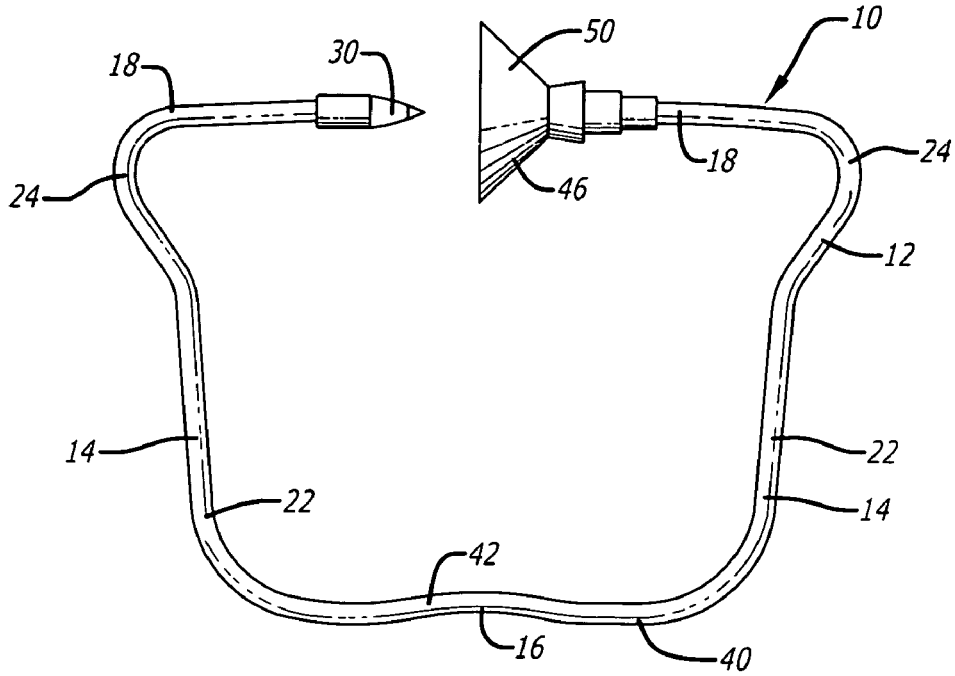
FIG. 1 is an elevational view of a clamping article in accordance with the present invention.

Referring to the drawings, and in particular to FIGS. 1–5, there is shown an article 10 which is able to be utilized for clamping a plurality of objects such as a plurality of sheets together. The plurality of sheets may be comprised of a material such as wood or marble, to be laminated together upon bonding thereof. There may be a layer of a material such as glue between the plurality of sheets, for enabling the plurality of sheets to be secured together responsive to the application of pressure thereto by the clamping article 10.

The clamping article 10 includes a body portion 12, for example comprised of spring wire and formed in a generally c-shape. The body portion 12 is preferably round in cross-section. In a preferred embodiment, the body portion 12 is formed in a generally block-c-shape. The body portion 12 is comprised of a pair of side portions 14, an intermediate portion 16 extending between and interconnecting the pair of side portions 14, and a pair of opposed free end portions 18 extending from the pair of side portions 14 and opposite the intermediate portion 16, and forming a gap 20 therebetween. The pair of opposed free end portions 18 are able to be aligned, and in the generally block-c-shape embodiment of the covering article 10, such block-c-shape is able to maintain the alignment thereof. The pair of opposed free end portions 18 are resiliently biased toward a position proximate each other and spaced apart to the extent of the gap 20 therebetween. They are able to be expanded away from each other upon the exertion of expansion pressure, to extend about the plurality of objects to be clamped therebetween, and to return to the resiliently biased position to exert pressure on the plurality of objects upon the release of the expansion pressure.

Each of the pair of side portions 14 preferably includes a generally straight portion 22, and a portion 24 which enables pressure to be exerted thereon for expansion of the article 10, which is generally curved outwardly away from the opposite side portion 14. The generally outwardly curved portion 24 of each of the pair of side portions 14 is located proximate the opposed free end portion 18 extending therefrom. The generally outwardly curved portion 24 of each of the pair of side portions 14 is engageable by an element 26 for enabling the application of pressure thereto and expansion thereof, and to provide leverage for enabling the exertion of pressure thereon.

Figure 4:
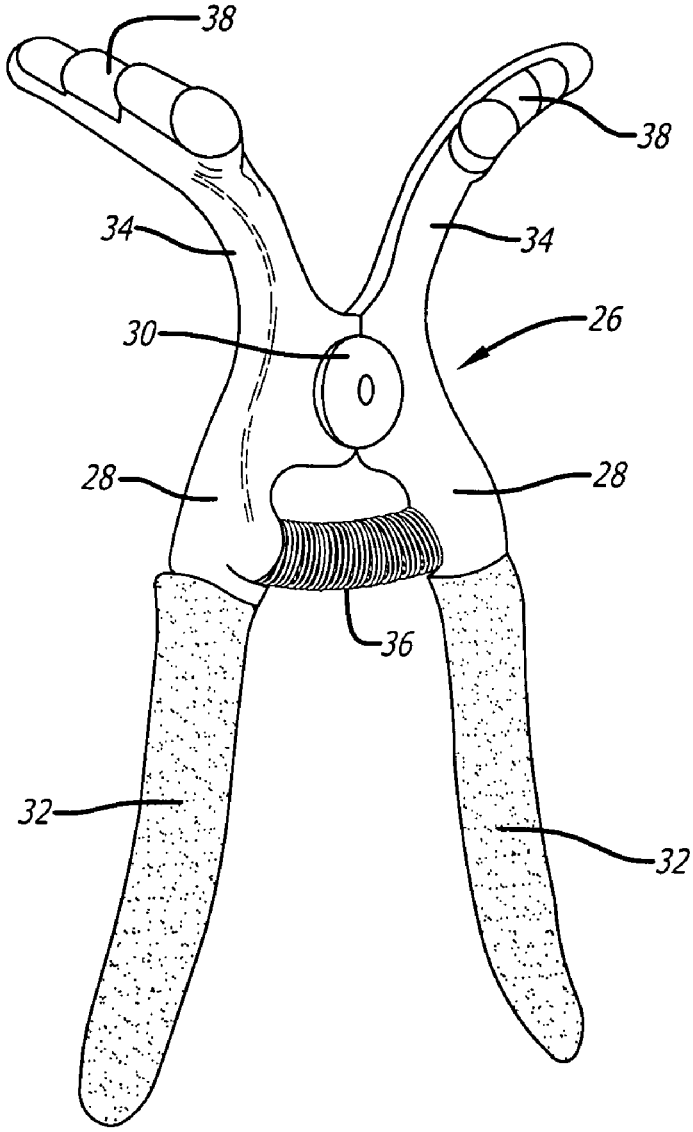
FIG. 4 is an elevational view of an article for engaging and expanding the clamping article in accordance with the present invention.

As shown in FIG. 4, the expansion enabling element 26 may include a pair of arms 28, pivotally connected together by a pivot 30. Each arm 28 includes a handle portion 32, and a generally outwardly extending portion 34. A biasing spring 36 interconnects the pair of handle portions 32, and biases the pair of outwardly extending portions 34 in the unexpanded position thereof. Each of the pair of generally outwardly extending portions 34 includes a stepped and indented surface 38, with corresponding pairs of the stepped surfaces 38 adapted to engage and enable expansion of the outwardly extending portions 34 of the expansion enabling element 26, at different locations thereof, upon engaging the generally outwardly curved portion 24 of each of the pair of side portions 14 of the clamping article 10, for opening and expanding thereof.

The intermediate portion 16 of the clamping article 10 includes a generally straight portion 40, and a medial portion 42 curved inwardly towards the pair of opposed free end portions 18. Each of the pair of opposed free end portions 18 preferably includes a pointed tip 44. The medial generally inwardly curved portion 42 of the intermediate portion 16 enables the return of the clamping article 10 to the resiliently biased position thereof upon the release of expansion pressure applied to the clamping article 10.

Figure 2:
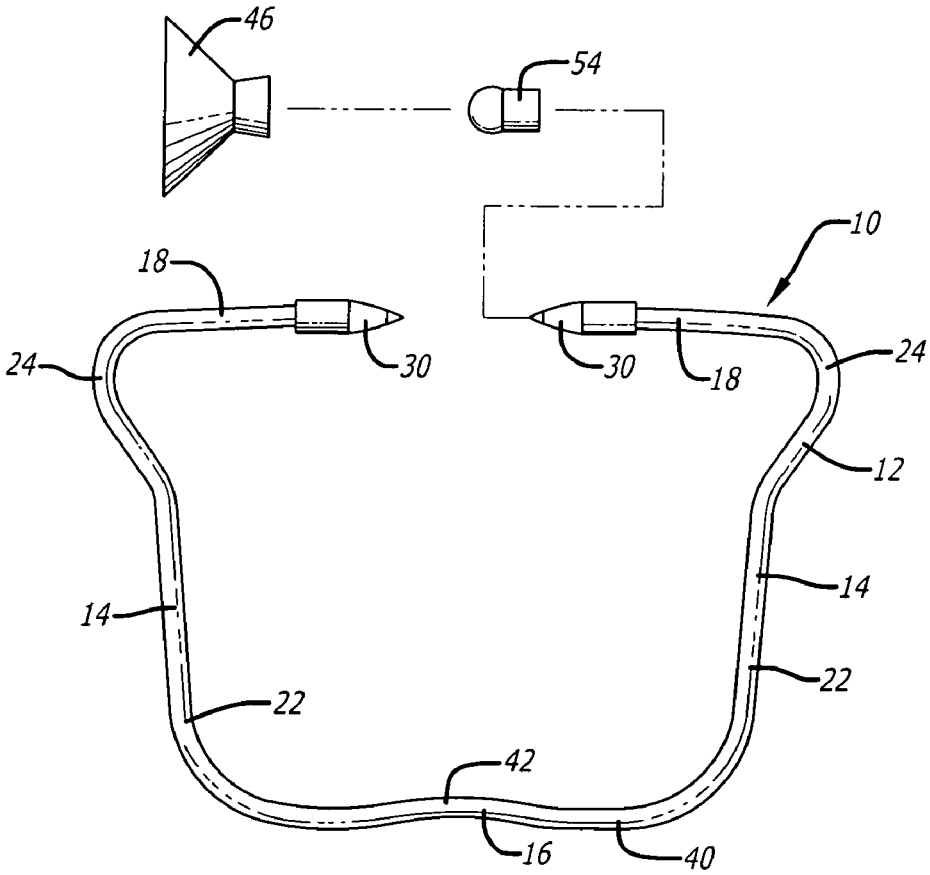
FIG. 2 is an exploded elevational view of the clamping article in accordance with the present invention.
Figure 3:
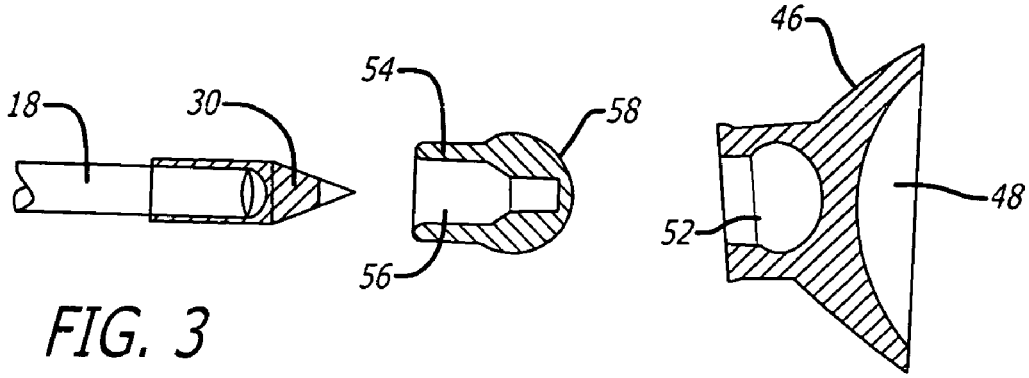
FIG. 3 is a partly fragmentary exploded view of a pointed tip and a covering element of the clamping article in accordance with the present invention.

The clamping article 10, as as seen in FIGS. 1–3 further includes an element 46 for covering a pointed tip 44, able to be positioned on one of the pair of opposed free end portions 18, including a surface 48 able to face and be positioned opposite the other of the pair of opposed free end portions 18. The facing surface 48 is preferably generally suction-cup shaped. The covering element 46 preferably includes an element 50 for enabling movement thereof relative to the pointed tip 44, such that the covering element 46 is able to face and bear against one of the plurality of objects to be clamped by the clamping article 10. The movement enabling element 50 preferably enables rotatable movement of the covering element 46. As shown in FIG. 3, the covering element 46 includes for example a cavity 52 in the end thereof opposite the facing surface 48. The clamping article 10 may further include an element 54 adapted to be positioned intermediate the pointed tip 44 and the covering element 46. The intermediately positionable element 54 includes a cavity 56 at one end thereof, generally complementary to the shape of the pointed tip 44, and a shaped opposite end 58 thereof generally complementary in shape to the shape of the cavity 52 in the covering element 46. The cavity 52 in the covering element 46 is preferably round, and the shaped opposite end 58 of the intermediately positionable element 54 is also preferably round.

Figure 5:
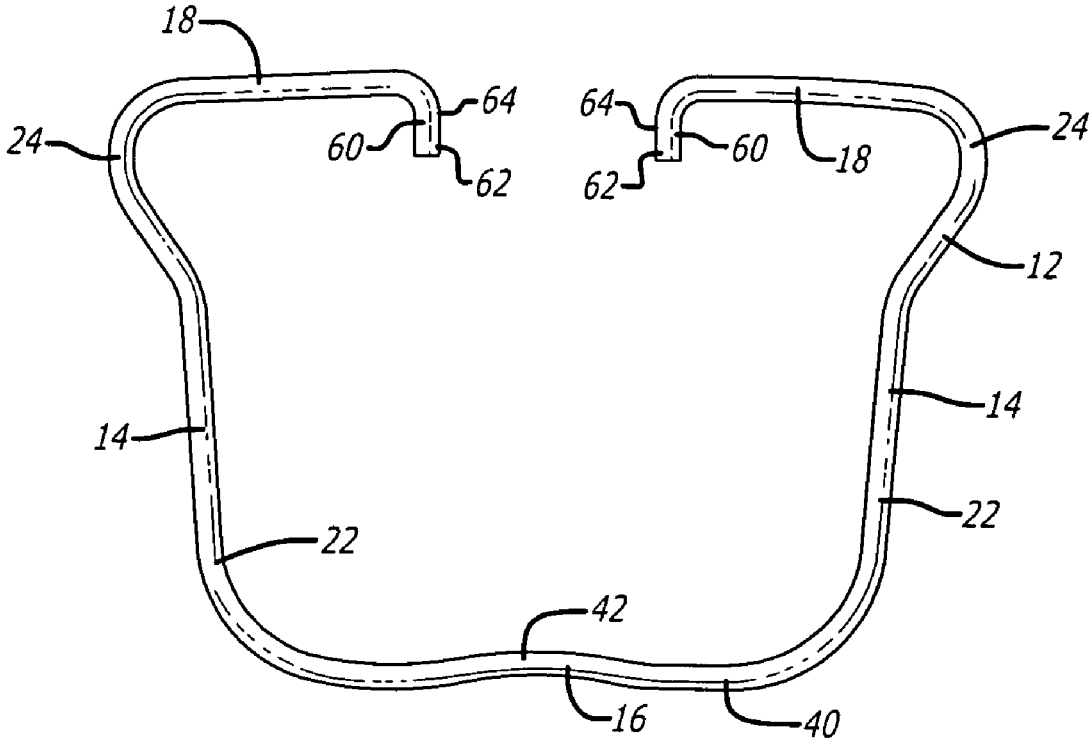
FIG. 5 is an elevational view of another embodiment of a clamping article in accordance with the present invention.

As seen in FIG. 5, each of the pair of opposed free end portions 18 includes a tip portion 60 bent so as to extend generally inwardly towards the intermediate portion 16. The body portion 12 of the clamping article 10 is generally round in cross-section, and each of the bent tip portions 60 includes a portion 62 able to face and be positioned opposite the other bent tip portion 60 and one of the plurality of objects. The facing portion 62 of each bent tip portion 60 includes a surface 64 able to contact one of the plurality of objects which it is able to face, and the contacting surface 64 preferably comprises a generally thin edge of the bent tip portion 60.

As illustrated in FIGS. 1–5, in a method for use of the clamping article 10, a corresponding pair of the stepped surfaces 38 of the expansion enabling element 26 are able to engage the generally outwardly curved portion 24 of the each of the pair of side portions 14 of the clamping article 10. Pressure may then be exerted on the handle portions 32 of the expansion enabling element 26 to move the handle portions 32 towards each other against the biasing pressure of the biasing spring 36, such that the outwardly extending portions 34 of the expansion enabling element 26 move away from each other about the pivot 30, causing the generally outwardly curved portion 24 of each of the pair of side portions 14, with which the corresponding pair of the stepped surfaces 38 of the expansion enabling element 26 are engaged, to expand outwardly. The expanded pair of opposed free end portions 18 of the clamping article 10 may then be extended about the plurality of objects to be clamped therebetween.

The pressure exerted on the handle portions 32 of the expansion enabling element 26 may then be released, enabling the biasing spring 36 to bias and move the handle portions 32 away from each other, and the outwardly extending portions 34 thereof to move towards each other about the pivot 30, and enabling the return of the resiliently biased pressure of the clamping article 10, so as to exert pressure on the plurality of objects clamped between the opposed free end portions 18 of the clamping article 10. The movement enabling element 50 enables the movement thereof against the object to be clamped and relative to the pointed tip 44 of the clamping article 10, so as to directly face and contact the surface of one of the objects to be clamped by the clamping article 10. To release the clamping article 10 from exerting pressure on the plurality of objects clamped between the opposed free end portions 18 thereof, the above process of engagement and exertion of expansion pressure by the expansion enabling article 26 on the clamping article 10 may be repeated.

From the foregoing it will be appreciated that the system of the present invention provides advantages in clamping a plurality of articles together. While several particular forms of the invention have been illustrated and described, it will be apparent that various modification can be made without departing from the spirit and scope of the invention. Accordingly, the invention is not to be limited, except as by the following claims.

What is claimed is:

1. An article for clamping a plurality of objects together, comprising:

a body portion, comprised of spring wire, formed in a generally c-shape, including:

a pair of side portions;

an intermediate portion, extending between and interconnecting the pair of side portions; and a pair of opposed free end portions, extending from the pair of side portions and opposite the intermediate portion, and forming a gap therebetween, which are resiliently biased by the pair of side portions and the intermediate portion toward a position proximate each other and spaced apart to the extent of the gap therebetween, and are adapted to be expanded away from each other upon the exertion of expansion pressure on the pair of side portions, so as to extend about the plurality of objects to be clamped between the pair of opposed free end portions, and to resiliently compress towards each other and return to the resiliently biased position thereof to exert pressure on and clamp the plurality of objects between the pair of opposed free end portions upon the release of the expansion pressure and compression of the pair of side portions responsive thereto;

wherein the pair of side portions, the intermediate portion, and the pair of opposed free end portions all extend in the same plane, and wherein the intermediate portion includes a medial portion generally curved inwardly towards the pair of opposed free end portions.

2. The article of claim 1, wherein each of the pair of side portions includes a pressure exertion enabling portion adapted to enable engagement thereof and pressure to be exerted thereon for expansion of the clamping article, and wherein the pressure exertion enabling portion of each of the pair of side portions comprises a generally outwardly curved portion which is generally curved outwardly away from the opposite side portion.

3. The article of claim 1, wherein the generally inwardly curved medial portion of the intermediate portion is adapted to enable the return of the article to the resiliently biased position upon the release of expansion pressure.

4. The article of claim 2, wherein the generally outwardly curved portion of each of the pair of side portions is located proximate the opposed free end portion extending therefrom.

5. The article of claim 2, wherein the generally outwardly curved portions of the pair of side portions are adapted to provide leverage for enabling the exertion of expansion pressure thereon.

* * * * *